US006699074B1

(12) United States Patent
Wu et al.

(10) Patent No.: US 6,699,074 B1
(45) Date of Patent: Mar. 2, 2004

(54) CABLE CONNECTOR ASSEMBLY HAVING IMPROVED GROUNDING MEANS

(75) Inventors: Chin Shen Wu, Tu-Chen (TW); Hong Bin Zhou, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,989

(22) Filed: Dec. 24, 2002

(30) Foreign Application Priority Data

Dec. 17, 2002 (TW) ..... 91220452 U

(51) Int. Cl.[7] ..... H01R 13/648
(52) U.S. Cl. ..... 439/608
(58) Field of Search ..... 439/607, 608, 439/609, 610, 701

(56) References Cited

U.S. PATENT DOCUMENTS 5,611,711 A * 3/1997 Okada et al. ..... 439/608
5,865,651 A * 2/1999 Dague et al. ..... 439/680
6,056,578 A * 5/2000 Lin ..... 539/358
6,074,218 A * 6/2000 Wu et al. ..... 439/63
6,210,216 B1 * 4/2001 Tso-Chin et al. ..... 439/545
6,439,926 B1 * 8/2002 Kuan ..... 439/607

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

A cable connector assembly (1) includes a housing (10), a plurality of electrical connectors (20, 30), a shielding member (40), a plurality of cables (50, 60) and outstretched wires (26, 36). The housing defines a plurality of positioning slits (110) recessing inwardly from a bottom face. The positioning slit has a receiving part (111) at a front end thereof and a holding part (112) communicating with the receiving part. The shielding member encloses a front portion of the housing with a retaining portion (407) received in the receiving part of the positioning slit. Each outstretched wire electrically connects with a grounding conductor of the cable and can be retained in the holding part of the positioning slit of the housing with a front end thereof soldered on the retaining portion of the shielding member for providing a grounding transmission.

4 Claims, 5 Drawing Sheets

CABLE CONNECTOR ASSEMBLY HAVING IMPROVED GROUNDING MEANS

CROSS-REFERENCE TO RELATED APPLICATION

This patent application is a co-pending application of U.S. Patent Application contemporaneously filed on the same date with the present invention with Ser. No. 10/330,990, entitled "CABLE CONNECTOR ASSEMBLY", invented by Zhou hong bin and Zhi gang cai, and assigned to the same assignee as the present application.

BACKGROUND OF THE INVENTION

1. Field of the Invention

The present invention generally relates to a cable connector assembly, and particularly to a cable connector assembly having an improved grounding means.

2. Description of Related Art

A cable connector assembly is often devised to electrically connect two or more electronic apparatuses, such as a mother board of a computer and a peripheral equipment. The cable connector assembly includes an electrical connector and a cable electrically connected with the electrical connector. The electrical connector comprises a grounding member electrically connecting with the electronic apparatuses for eliminating noise.

Furthermore, the cable of the cable connector assembly contains a plurality of grounding conductors electrically soldered on the shielding member of the electrical connector for providing a grounding transmission therebetween. Understandably, the grounding transmission is an important factor for the cable connector assembly which directly result the shielding effect. However, the mechanical connection of the grounding conductors and the shielding member by merely soldering therebetween is not reliable. The grounding transmission may be possibly affected.

Hence, a cable connector assembly having an improved grounding means is required to overcome the disadvantages of the related art.

SUMMARY OF THE INVENTION

An object of the present invention is to provide a cable connector assembly having an improved grounding means.

In order to achieve the object set forth, a cable connector assembly in accordance with the present invention includes a housing, a plurality of electrical connectors, a shielding member, a plurality of cables and outstretched wires. The housing defines a plurality of positioning slits recessing inwardly from a bottom face. The positioning slit has a receiving part at a front end thereof and a holding part communicating with the receiving part. The shielding member encloses a front portion of the housing with a retaining portion received in the receiving part of the positioning slit. Each outstretched wire electrically connects with a grounding conductor of the cable and can be securely retained in the holding part of the positioning slit of the housing with a front end thereof soldered on the retaining portion of the shielding member thereby providing a reliable grounding transmission.

Other objects, advantages and novel features of the invention will become more apparent from the following detailed description when taken in conjunction with the accompanying drawings.

DETAILED DESCRIPTION OF THE INVENTION

Figure 1:
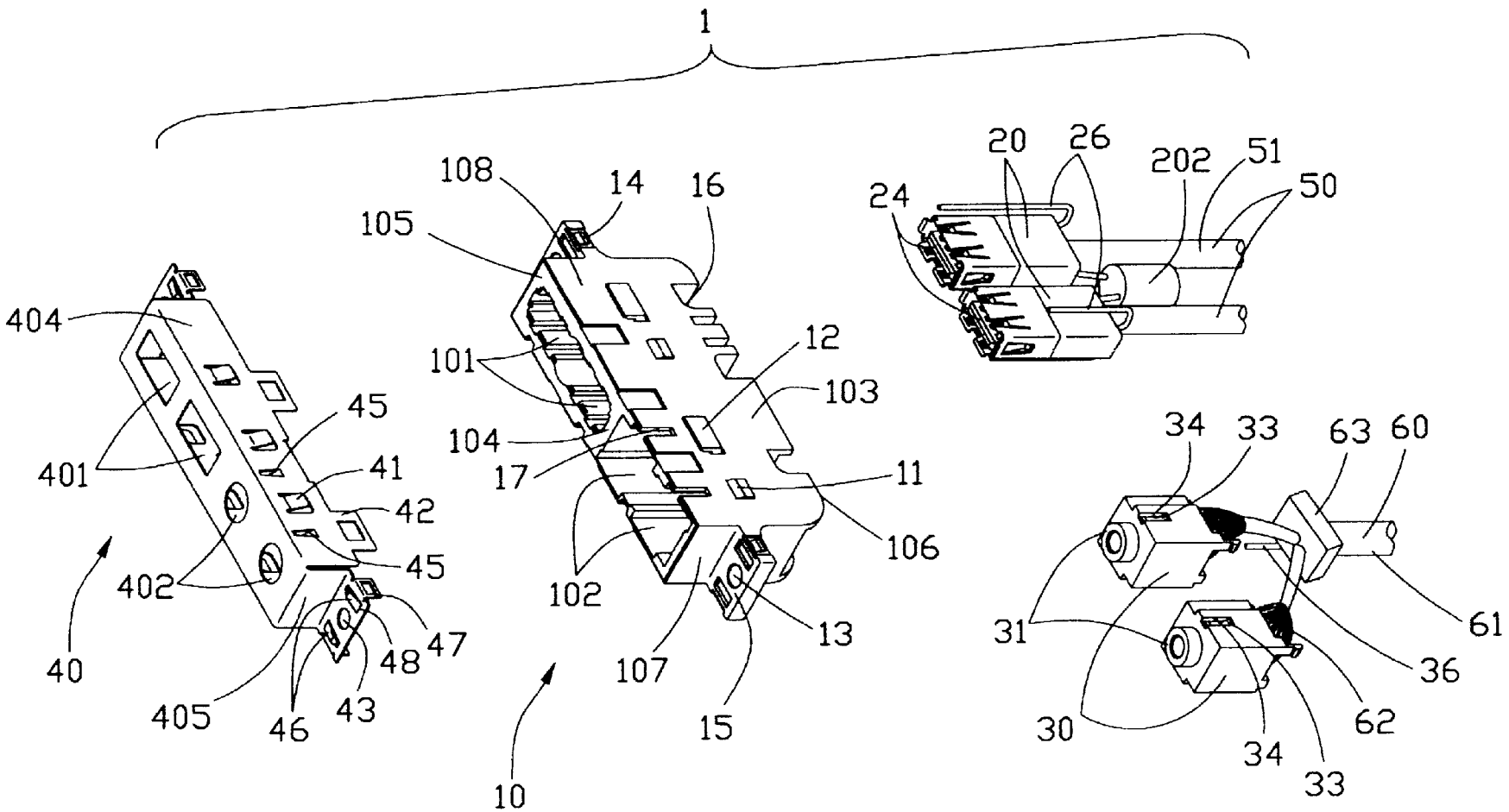
FIG. 1 is an exploded, perspective view of a cable connector assembly in accordance with the present invention.
Figure 2:
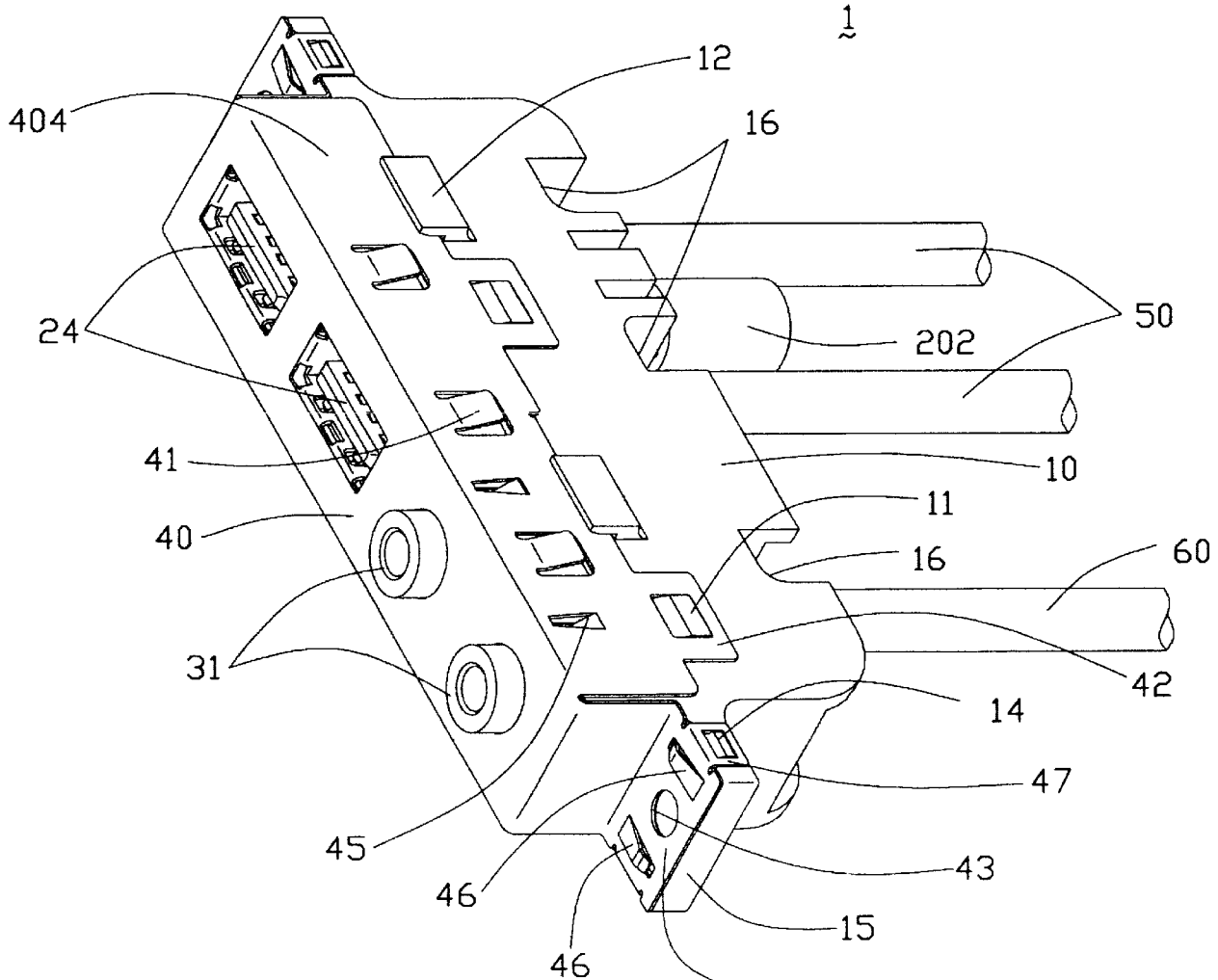
FIG. 2 is an assembled perspective view of the cable connector assembly of FIG. 1, from a top aspect.

Referring to FIGS. 1–2, a cable connector assembly in accordance with the present invention, generally designated 1, is adapted for mating with a plurality of complementary connectors (not shown). The cable connector assembly 1 includes a dielectric housing 10, a set of electrical connectors consisted of a pair of first connectors 20 and a pair of second connectors 30, a shielding member 40, a pair of first cables 50 and a second cable 60. In the preferred embodiment, the first electrical connectors 20 are typical standard Universal Serial Bus (USB) connectors and the second electrical connectors 30 are audio jack connectors. However, in alternative embodiments, the electrical connectors could be provided with any suitable types connectors.

Figure 4:
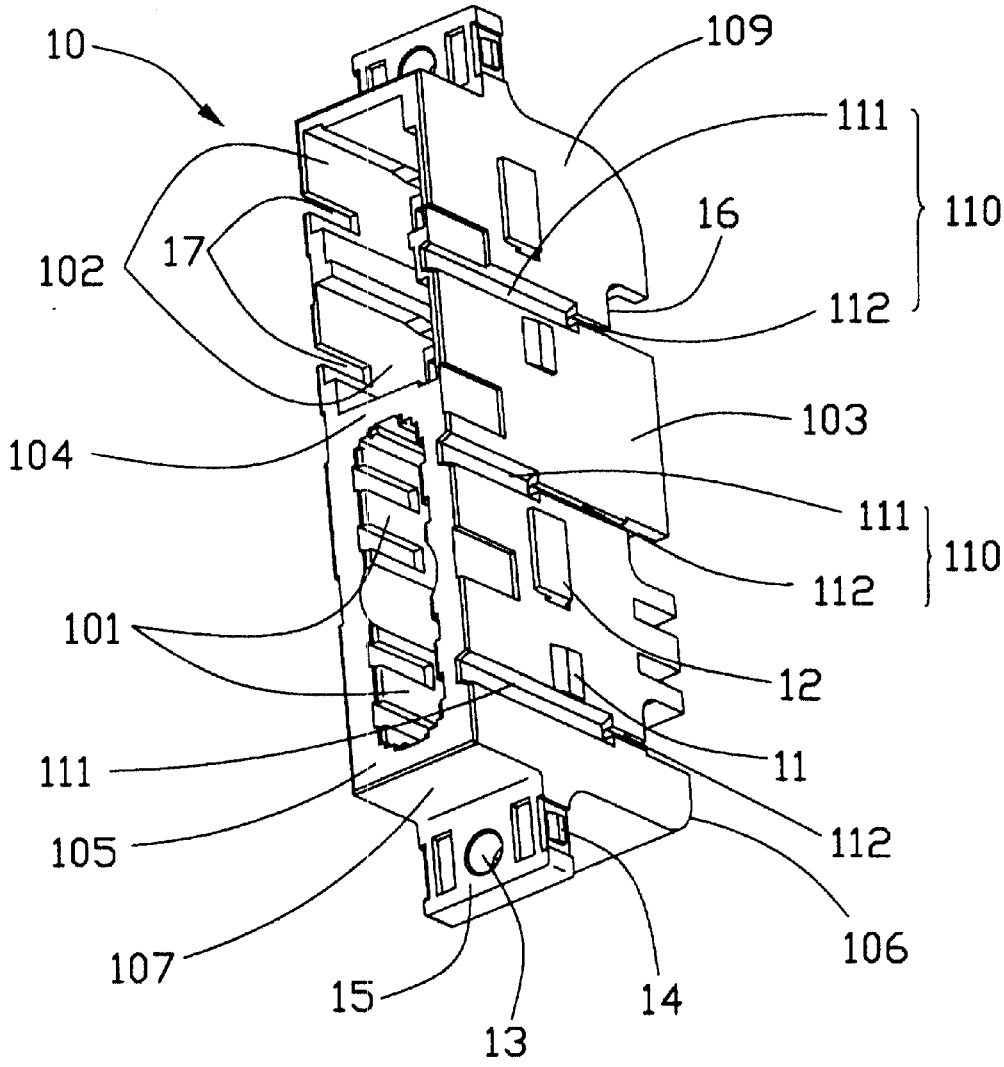
FIG. 4 is a perspective view of a housing of the cable connector assembly of FIG. 1.

The dielectric housing 10 generally molded of plastic or polymer material has an elongate base 103. As shown in FIG. 1 and FIG. 4, the base 103 has a mating face 105, a rear face 106 opposite to the mating face 105, a top face 108, a bottom face 109 opposite to the top face 108, and a pair of lateral ends 107 connecting the mating face 105 and the rear face 106. The base 103 defines a pair of first cavities 101 communicating with each other for respectively receiving the first connectors 20 therein, a pair of second cavities 102 communicating with each other for respectively receiving the second connectors 30 therein, and an intermediate wall 104 partitioning the first cavities 101 and the second cavities 102. The base 103 defines a pair of slots 17 from the top face 108 and each slot 17 communicates with a corresponding second cavity 102. A plurality of wedge protrusions 11 respectively projects upwardly and downwardly from the top face 108 and the bottom face 109 of the base 103. A plurality of holding portions 12 respectively projects upwardly and downwardly from the top face 108 and the bottom face 109 and aligning with the wedge protrusions 11. The holding portion 12 is L-shaped and defines a cutout (not labeled) at the front end thereof between the holding portion 12 and the top face 108 of the base 103 for receiving edges of the shielding member 10. A pair of side blocks 15 protrudes outwardly from the pair of lateral ends 107 of the base 103. Each side block 15 defines a retaining hole 13. A pair of wedge ribs 14 is disposed respectively at a top and a bottom of each side block 15.

A plurality of passageways 16 is defined in the base 103 from the rear face 107 recessing inwardly and respectively communicates with the first cavity 101 and the second cavity 102. The passageways 16 are provided for receiving the first cables 50 and the second cable 60. The base 103 defines a plurality of positioning slits 110 recessing inwardly from the bottom face 109 and aligning with the passageways 16 thereof, as best shown in FIG. 4. The positioning slits 110 extend forwardly and parallel to the lateral ends 107. Each positioning slit 110 has a holding part 112 adjacent to the rear face 107 and a receiving part 111 at the front end thereof communicating with the holding part 112. The receiving part 111 extends towards the mating face 105 and has a transverse dimension larger than that of the holding part 112.

Also referring to FIG. 1, the first connectors 20 are a pair of typical USB connectors arranged in a side by side manner. The second connectors 30 are a pair of typical audio jack connectors side by side arranged. Structures of the USB connectors and audio jack connectors are well known to persons skilled in the art, detailed description thereof is omitted here. Each first connector 20 has a mating port 24 at the front portion thereof. A capacitor 202 is disposed between the rear portions of the first connectors 20 for providing a filterable function. Each second connector 30 defines a cutout 34 on a top face thereof and adjacent to a mating port 31 thereof. The second electrical connector 30 further comprises a grounding terminal 33 extending into the cutout 34 and exposed therein.

The pair of first cables 50 is respectively connected with the pair of first connectors 20. Each first cable 50 contains a plurality of signal conductors (not shown) electrically connected with corresponding terminals (not labeled) of the first connector 20, a plurality of grounding conductors (not shown), and an insulative layer 51 enclosing the signal conductors and the grounding conductors. The tip part of each first cable 50 is stripped of the insulative layer 51 so that the grounding conductors are exposed for being soldered on an outer shield of the first connector 20. A first outstretched wire 26 soldered on the outer shield of the first connector 20 extends rearward from the first connector 20. The grounding path from the outstretched wire 26, the outer shield of the first connector 20, and the grounding conductors of the first cable 50 is thus established. It should be noted that in an alternative embodiment, the first outstretched wire 26 can be directly electrically connected with the grounding conductor of the first cable 50. Furthermore, the first outstretched wire 26 can be defined as a part of the grounding conductor of the first cable 50 which is also feasible.

The second cable 60 has a pair of segments at the front end thereof for respectively connected with the second electrical connectors 30. Similar to the first cables 50, each second cable 60 contains a plurality of signal wires 62 electrically connected with corresponding terminals (not labeled) of the second connector 30, a plurality of grounding wires (not shown), and an insulative layer 61 enclosing the signal wires and the grounding wires. The second cable 60 has a retaining board 63 over-molded with and enclosing an end of the second cable 60. The retaining board 63 is rectangular and engages with the housing 10 for providing a retention between the housing 10 and the second cable 60. The tip part of second cable 60 is stripped of the insulative layer 61 so that a front end of the grounding wire is exposed to form a second outstretched wire 36. The second outstretched wire 36 extends forwardly under the retaining board 63.

Figure 5:
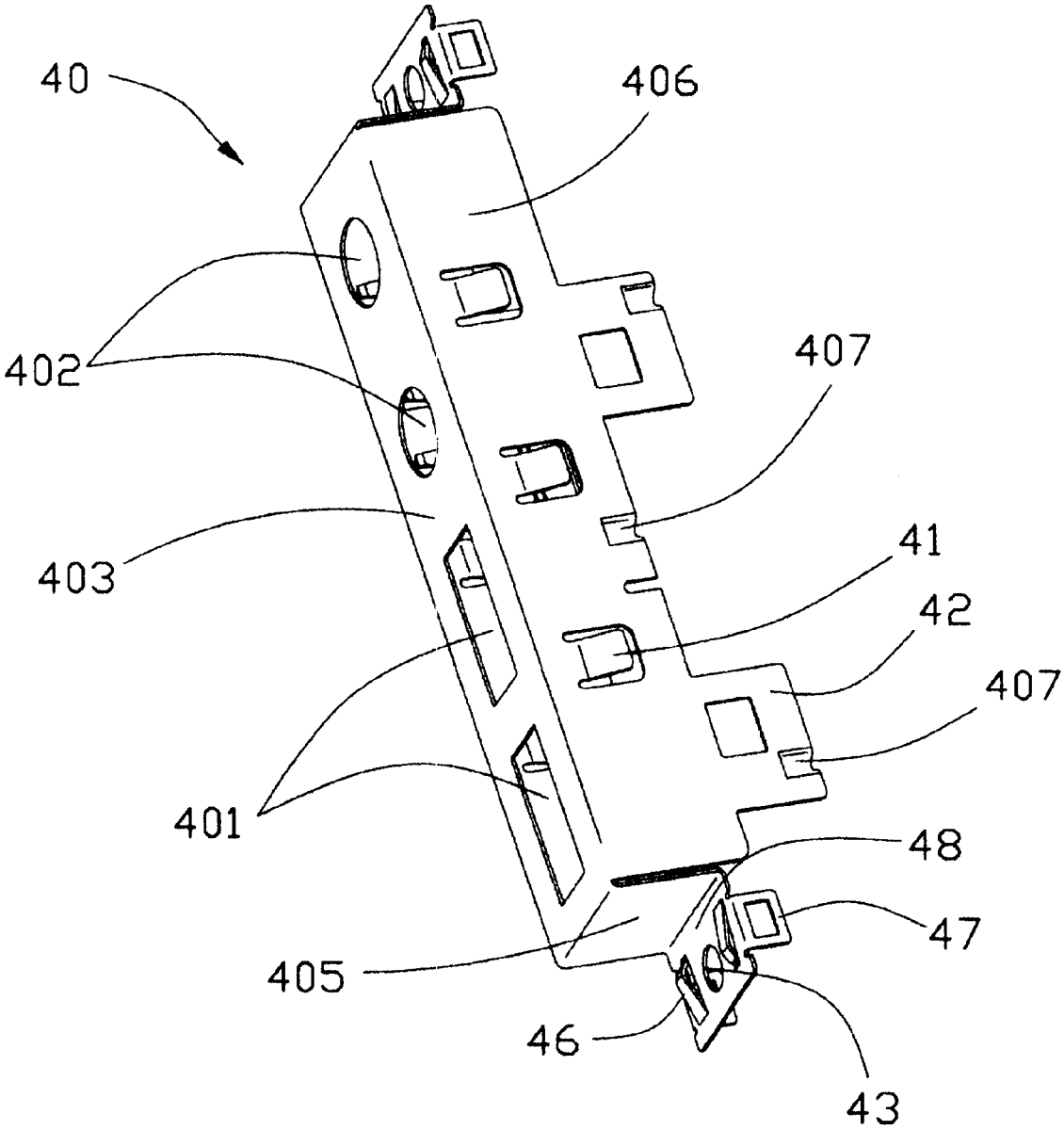
FIG. 5 is a perspective view of a shielding member of the cable connector assembly of FIG. 1.

Referring to FIG. 1 and FIG. 5, the shielding member 40 is generally stamped from a piece of metal or other conductive materials. The shielding member 40 is in an elongate frame shape for substantially shielding the front portion of the housing 10. The shielding member 40 comprises a front wall 403, a top wall 404 and a bottom wall 406 respectively extending rearward from opposite top and lower sides of the front wall 403, and a pair of lateral walls 405 connecting with opposite lateral sides of the top wall 404 and the bottom wall 406. The front wall 403 defines a pair of first holes 401 aligning with the first cavities 101 and a pair of second holes 402 aligning with the second cavities 102 so as for allowing mating ports 31 of the second electrical connectors 30 extending therethrough. The first hole 401 is rectangular and the second hole 402 is round. Each of the top wall 404 and the bottom wall 406 is stamped to form a plurality of engaging taps 41 protruding outwardly and a pair of contact taps 45 protruding inwardly therefrom. The engaging taps 41 are devised for electrically engaging with a panel of a computer when the cable connector assembly 1 is assembled in the computer. The contact taps 45 extend through the slots 17 of the housing 10 and electrically mates with the grounding terminals 33 retained in the cutouts 34 therein.

A plurality of retaining flakes 42 extends rearward from the top wall 404 and the bottom wall 406 which define a cutout (not labeled) for receiving the wedge protrusions 11 of the base 101. Each retaining flake 42 of the bottom wall 406 defines a retaining portion 407 adjacent to rear side thereof. The retaining portion 407 is formed in the shape of an arc by stamping. The arc retaining portion 407 is a recess compared to the bottom wall 406 and an aperture 408 (shown in FIG. 3) is defined at the front end of the retaining portion 407. A pair of side plates 48 each bends from a rear side of the lateral walls 405. Each side plate 48 defines a hole 43 corresponding to the retaining hole 13 of the side block 15 of the housing 10 for a corresponding screw extending therethrough. A plurality of engaging taps 46 is stamped and protrudes forwardly therefrom for electrically engaging with the panel of the computer which is similar to the engaging taps 41 formed on the sidewalls 404. A pair of retaining flakes 47 respectively bends from the top and lower sides of each side plate 48 which defines a cutout (not labeled) for receiving a corresponding wedge rib 14 of the side block 15 for providing a retention therebetween.

Figure 3:
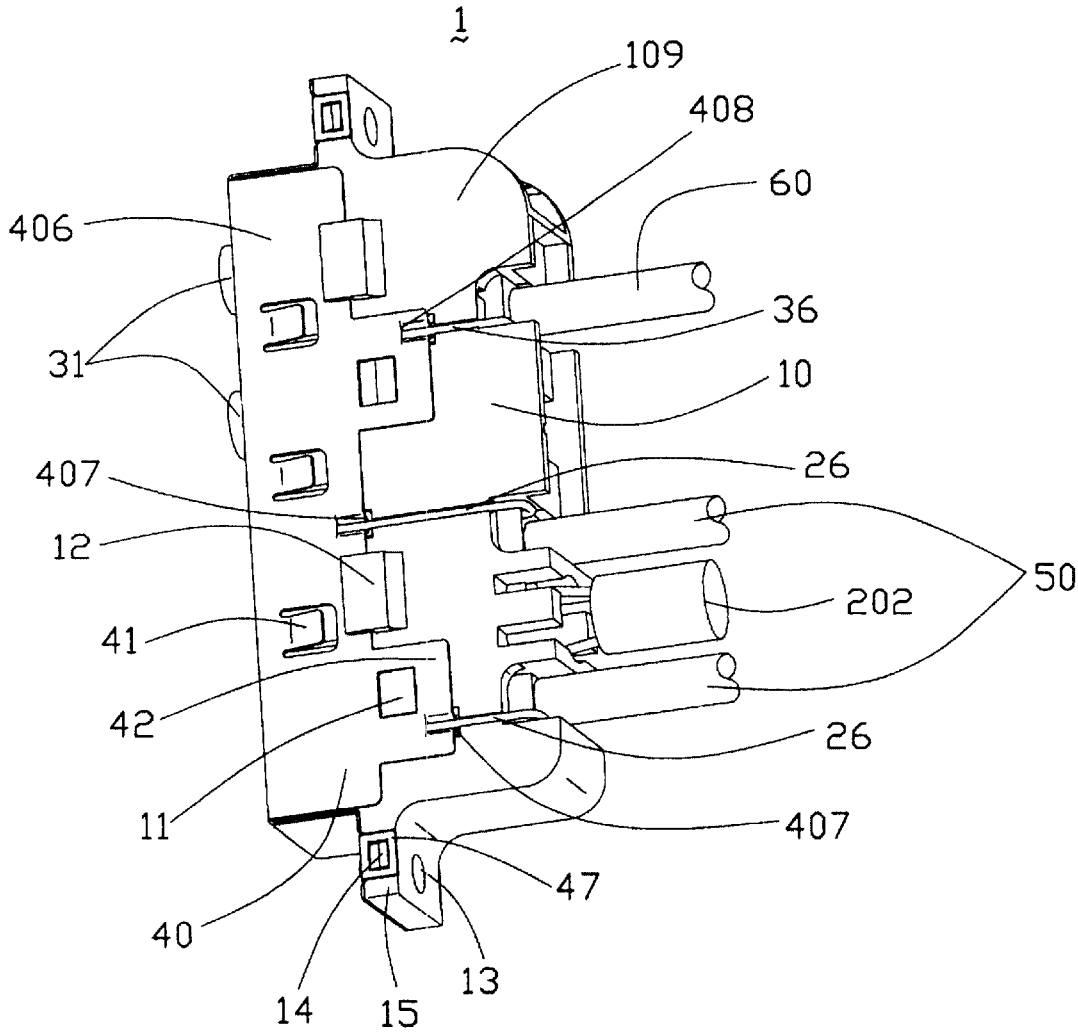
FIG. 3 is a view similar to FIG. 2, but taken from a bottom aspect.

In assembly, as shown in FIGS. 1–3, the first connectors 20 and the second connectors 30 respectively connect with the first cables 50 and the second cable 60 with the terminals (not labeled) thereof respectively soldered to the corresponding signal conductors of the first cables 50 and the second cable 60 which is well known for persons skilled in the art and the detailed description is omitted here. The first electrical connectors 20 and the second electrical connectors 30 are respectively inserted into the first cavities 101 and the second cavities 102 from a mating face 105 of the base 101 with the mating ports 24 and the mating ports 31 thereof exposed away the mating face 105. Correspondingly, the first cables 50 and the second cable 60 extend through the passageway 16 and beyond the rear face 106 of base 101.

Subsequently, the shielding member 40 is assembled to the housing 10 with the front wall 403 thereof abutting against the mating face 105 of the base 101. The top wall 404, the bottom wall 406 and the lateral walls 405 of the shielding member 40 enclose the front portion of the base 101 with the rear edges retained in the cutouts of the holding portion 12. Each side plate 48 of the shielding member 40 engages with the side block 15 of the housing 10. The retaining flakes 42, 47 are respectively engaged with the wedge protrusions 11 and the wedge ribs 14 of the base 103 for providing a reliable retention therebetween. The first holes 401 and the second holes 402 respectively aligns with the first cavities 101 and the second cavities 102 for allowing the mating ports 24 of the first electrical connectors 20 and the mating ports 31 of the second electrical connectors 30 extending therethrough.

The retaining portion 407 of the shielding member 40 is snugly retained in the receiving part 111 of the positioning slit 110 of the housing 10. Each of the outstretched wires 26, 36 is respectively received in the hold part 112 of the positioning slit 110 with a free end thereof soldered on the retaining portion 407 retained in the receiving part 111. Since the housing 10 of the cable connector assembly 1 defines the positioning slits 110 respectively receiving the outstretched wires 26, 36 and the retaining portions 407 of the shielding member 40 therein, so that the outstretched wires 26, 36 are thus reliably retained. The electrical and mechanical connection between the outstretched wires 26, 36 and the shielding member 40 is corresponding enhanced.

In the preferred embodiment of the present invention, the cable connector assembly 1 defines the positioning slits 110 in the bottom face 109 of the housing 10. Of course, it is easily understood the persons skilled in the art that the positioning slits 110 can be defined in the top face 108, or the lateral end 107 of the housing 10. Furthermore, it should be noted that the cable connector assembly 1 comprises a plurality of connectors, such as the first connectors 10, the second connectors 20. However, the cable connector assembly 1 can have only one connector in an alternative embodiment. Understandably, only one cable is required to electrically connected with the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a housing having an elongate base and defining a pair of first cavities in communication with each other and a pair of second cavities in communication with each other and arranged in a side by side manner, an intermediate wall partitioning the first and second cavities, a plurality of wedge protrusions respectively projecting upwardly and downwardly form a top and a bottom face of the base, a positioning slit each comprising a narrow holding part and a wide receiving part formed on an exterior face of said housing;

a pair of first connectors which are typical Universal Serial Bus connectors and a pair of second connectors which ate typical audio jack connectors, respectively received in the first and second pairs of cavities, the first connectors comprising a capacitor which is disposed between rear portions thereof for providing a filterable function, a first outstretched wire soldered on an outer shield and extending rearward from each of the first connectors, a cable connected to the second connector, the cable having a rectangular retaining board over-molded with and enclosing an end of the cable, a tip of the cable being stripped of an insulative layer so that a front end of a grounding wire is exposed to form a second outstretched wire which extends forwardly under the retaining board;

a shield member enclosing a front portion of the housing, the shielding member comprising a front wall which defines a pair of rectangular holes aligning with the pair of first cavities and a pair of round holes aligning with the pair of second cavities, a plurality of retaining flakes extending rearward from a top and a bottoms walls of the shielding which define cutouts for receiving the wedge protrusions of the base, one of said top and bottom walls forming a retaining portion received in the holding part of the positioning slit, the retaining portion formed on the retaining flake by stamping, each of said first and second outstretched wires being received in the positioning slit with a front end thereof connected with the retaining portion of the shielding member.

2. The cable connector assembly as claimed in claim 1, wherein the side face of the base is a bottom face, the base further has a pair of lateral ends connecting with the bottom face.

3. The cable connector assembly as claimed in claim 2, wherein the positioning slit of the base extends forwardly and parallel to the lateral ends of the base.

4. The cable connector assembly as claimed in claim 1, wherein the retaining portion of the retaining flake is formed in a shape of an arc.

* * * * *